US005819934A

United States Patent [19]

Cooper

[11] Patent Number: 5,819,934

[45] Date of Patent: Oct. 13, 1998

[54] WIRE TRANSPORT DRUM

[75] Inventor: William D. Cooper, Chardon, Ohio

[73] Assignee: The Lincoln Electric Company, Cleveland, Ohio

[21] Appl. No.: 958,244

[22] Filed: Oct. 27, 1997

[51] Int. Cl.[6] ..... B65D 85/04

[52] U.S. Cl. ..... 206/397; 206/408

[58] Field of Search ..... 206/389, 397, 206/408, 409; 242/129, 171

[56] References Cited

U.S. PATENT DOCUMENTS 4,869,367 9/1989 Kawasaki et al. ..... 206/409
5,105,943 4/1992 Lesko et al. ..... 206/397

FOREIGN PATENT DOCUMENTS 43-14571 6/1968 Japan .

*Primary Examiner*—Jim Foster
*Attorney, Agent, or Firm*—Vickers, Daniels, Young

[57] ABSTRACT

A drum with a cylindrical body having an upper end and a lower end and a circular bottom wall secured across said lower end includes a cylindrical core having an inner cylindrical surface, an upper end and a lower end which is fixedly secured to the bottom wall to define an annular wire receiving space between said core and said body of said drum wherein an improved wire biasing mechanism is provided for applying a downward force against wire in the wire receiving space, by a generally flat pressure ring resting on the wire and an elongated, elastic element connected to a loop element attached to the lower end of said core for pulling the pressure ring downwardly.

19 Claims, 4 Drawing Sheets

WIRE TRANSPORT DRUM

The present invention relates to the art of pasteboard drums used to transport loosely wound welding wire of the type often used in automatic welding by robotic equipment and more particularly to an improved drum assembly for transporting welding wire laid in the drum in loosely compacted convolutions.

INCORPORATION BY REFERENCE

It is common practice to ship large volumes of welding wire in pasteboard drums containing a center tubular core with the wire being drawn and deposited in the annular space between the core and the inside surface of the drum, as explained in Lesko 5,105,943, which is incorporated by reference herein. As the welding wire is drawn and deposited in the annular space between the pasteboard core and outer pasteboard surface of the drum in the manufacturing process the convolutions of welding wire are loosely deposited in the drum. As illustrated in the Lesko patent, as the wire is laid continuously into the annular space, it ultimately fills the space, after which the drum is closed. Lesko 5,105,943 illustrates an arrangement for placing a cap over the end of the center core to prevent the core from shifting during transient to the site using the welding wire. At that site, the drum is opened and the wire is payed out as a continuous strand passing through the welding gun to the welding operation. To hold the cap onto the top of the center core, Lesko 5,105,943 illustrates a lower loop element secured to, and integrated with, the bottom structure of the drum. The loop element in this prior patent is complicated to produce, difficult to assemble and substantially adds to the cost of the drum assembly. In addition, the illustrated drum merely prevents the wound wire from being displaced beyond the movable end cap during transportation of the drum.

This Lesko drum assembly does not address the major problem in transporting welding wire that has been loosely deposited in the annular space between the center core and drum. The volume of the wire decreases during vibration experienced in transportation. Consequently, the top portion of the wire moves downwardly, which movement could not be accommodated by the structure in Lesko 5,105,943. However, in practice the cap shown in Lesko is in the form of a flat ring of the general type disclosed in Kawasaki 4,869,367. FIGS. 3 and 5 of this patent illustrate a drum for welding wire of the type to which the present invention is directed with a lower loop element that pulls a disk shaped ring on the top of the welding wire downwardly by an elastic element between the ring and the lower loop element. In practice, the transport drum for welding wire utilizes the pressure ring concept in Kawasaki with a center pasteboard core, as shown in Lesko. To allow for the ring to be pulled downwardly during transportation of the drum within a center core, the core had vertically extending slots carrying a removable rod-like element extending outwardly over the top of the pressure ring to obtain the advantages of Kawasaki. The ring moves downwardly during transportation with the advantage of the center core, as shown in Lesko. The general construction used in practice is illustrated in Japanese Patent 43-14571, which is incorporated by reference herein, together with Kawasaki and Lesko. These three prior art patents explain the technology to which the present invention is directed as well as the general approach in constructing a transport drum of the type to which the present invention is directed.

BACKGROUND OF INVENTION

As illustrated in the patents incorporated herein, transportation of loosely wound welding wire is normally done in a pasteboard drum having a center cylindrical pasteboard core fixed onto the bottom of the drum. This defines an annular wire receiving space between the core and the body of the drum into which the welding wire is deposited. A wire biasing mechanism is used for applying a downward force against the wire that is deposited in the wire receiving space. This biasing mechanism includes a generally flat pressure ring as shown in Kawasaki 4,869,367 and in Japanese Patent No. 43-14571, which pressure ring is resting on the top of wire and can move downwardly as the wire mass compacts during transportation. This action prevents tangling of the wire and preserves the stability of the wire volume for subsequent use in automated robotic welding. To bias the pressure ring downwardly, a loop element is secured in the lower portion of the pasteboard core and an elastic element, such as an elastic band, is connected between a rod-like element extending through slots in the center core which is pulled downwardly by the action of the elastic elongated element, as shown in the prior art patents. The difficulty of this structure is that the loop element must be assembled as an integral part of the lower bottom structure of the drum. This has to be done before the lower end of the drum is attached to the drum itself. This manufacturing process is a complicated, expensive, labor intensive operation which substantially increases the cost of the transport drum. In the prior art, the loop element must be first manufactured and fixed to the lower end of the drum. Then the core must be assembled over the loop element in the bottom of the drum. This is a complex operation which has been a substantial disadvantage.

THE INVENTION

In accordance with the present invention, there is provided an improvement in the drum assemblies used to transport loosely wound welding wire from the manufacturer to the welding site. This improvement involves constructing the loop element as a flexible ribbon, cord or wire structure having spaced ends and a bight portion and means for fixing the ends of the loop element onto the core adjacent its lower end. In accordance with the invention, the loop element is attached to the bottom of the pasteboard cylindrical core of the type shown in Lesko 5,105,943. In this manner, the loop element is assembled near the bottom of the core, which is easy to accomplish, is done in the core itself and needs no subsequent alignment of the loop element with respect to any other portion of the drum. The core and loop element are assembled together and then the lower end of the core assembly is fixedly secured in the proper centered position on the bottom of the pasteboard drum. This is accomplished by using a reenforcing circular ring or plate glued to the bottom wall of the drum and having a central opening that receives the lower end of the core. The reenforcing plate is glued to the bottom wall and is also glued to the bottom portion of the central cylindrical core to fixedly support the core onto the bottom wall of the drum after the loop element has been affixed to and assembled on the lower portion of the core. This presents a substantial improvement and drastically reduces the number of assembly steps and the criticality of various steps used in assembling the transport drum.

The primary object of the present invention is the provision of an improved drum assembly for transporting a coil of loosely wound wire, which assembly maintains a downward pressure on the wire and utilizes a lower loop assembly which is inexpensive, positive in operation and easy to assemble.

Another object of the present invention is the provision of a drum assembly, as defined above, which drum assembly is easy to produce, rigid in operation and reduces the cost of the biasing mechanism for holding the pressure ring against the top portion of the welding wire deposited in the annular wire receiving space of the drum.

These and other advantages will become apparent from the following description taken together with the accompanying drawings.

PREFERRED EMBODIMENTS

Figure 1:
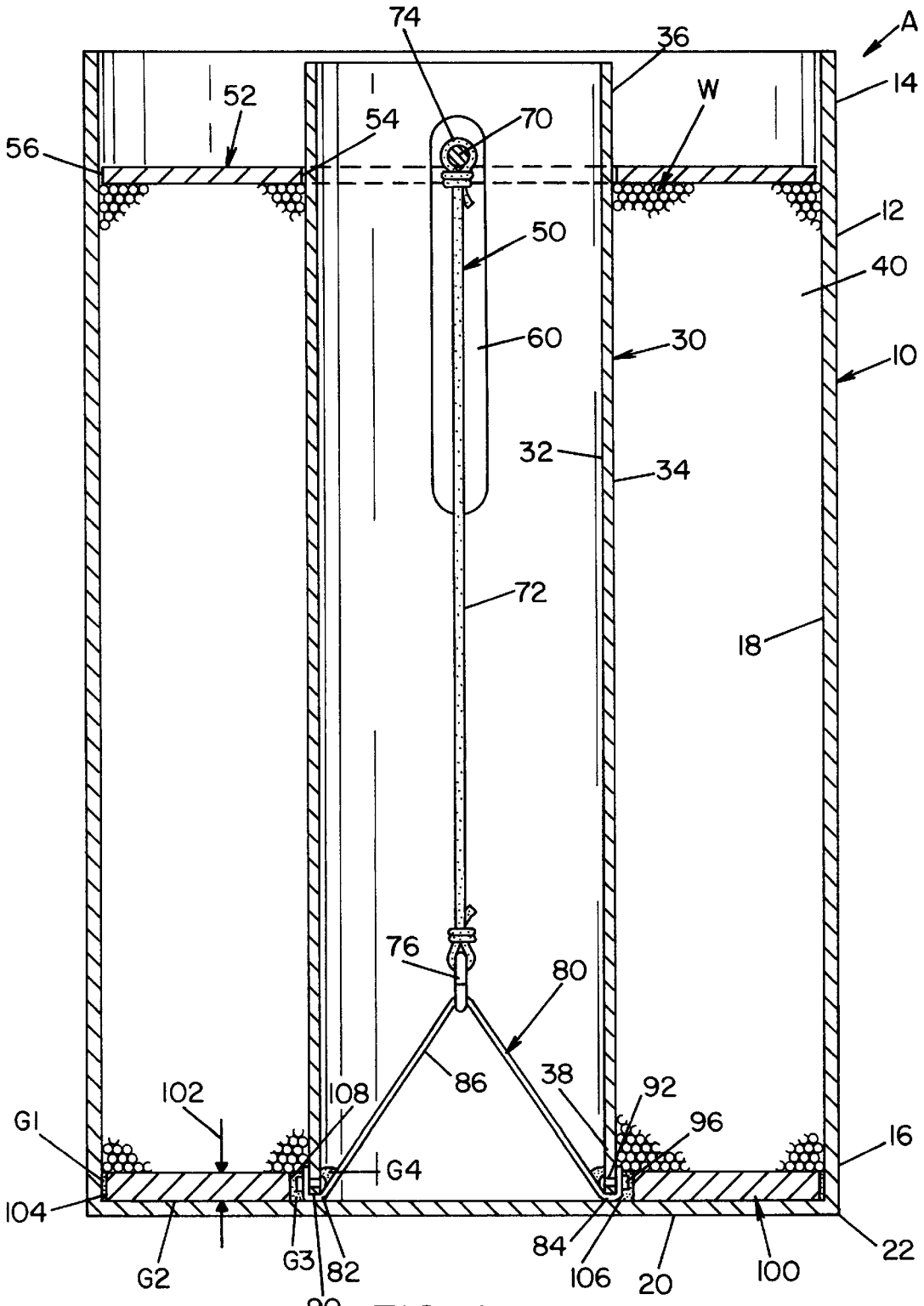
FIG. 1 is a cross sectional view of the preferred embodiment of the present invention.
Figure 2:
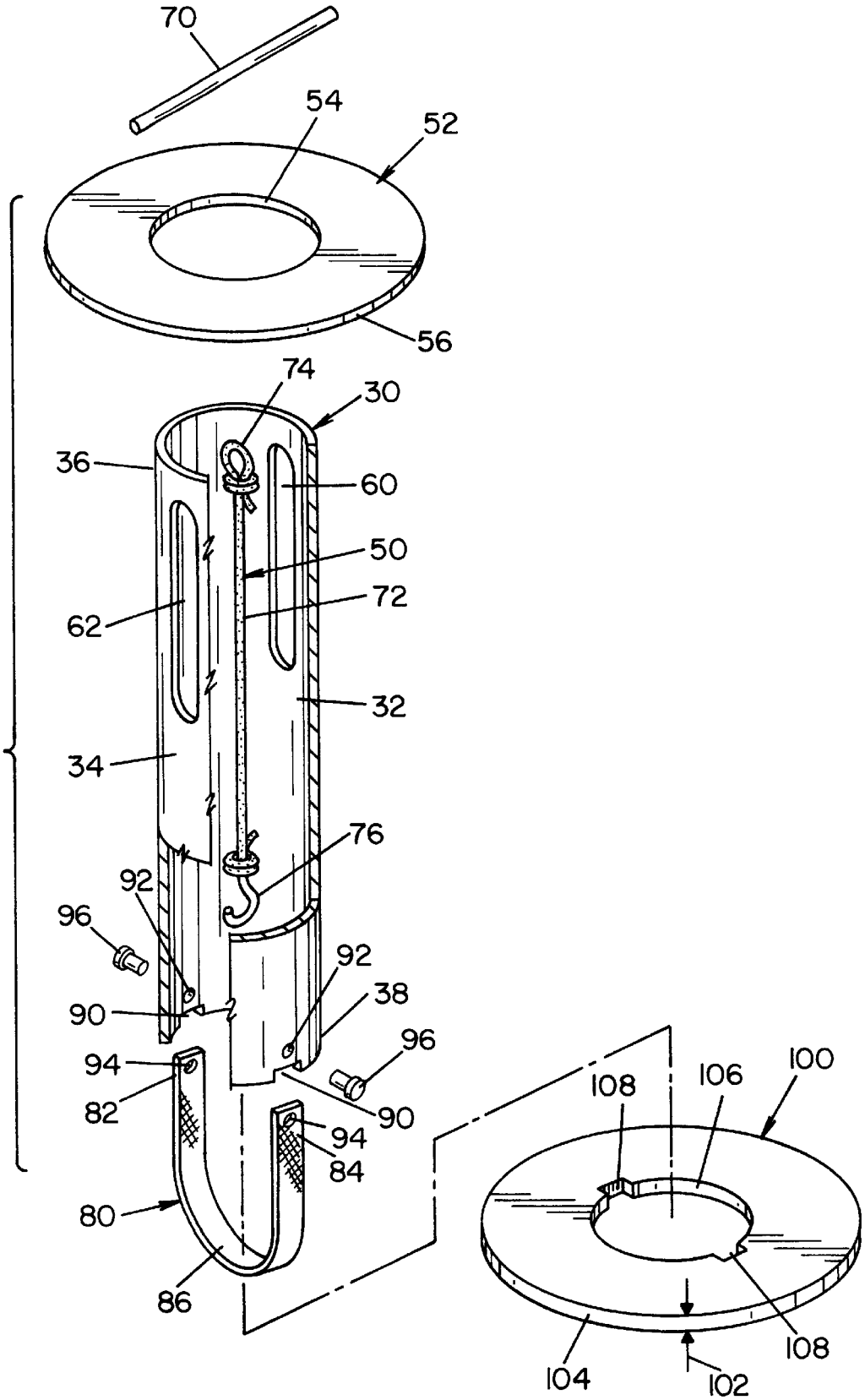
FIG. 2 is an exploded view of the individual components used in the preferred embodiment of the invention for assembly into a pasteboard drum to transport loosely coiled welding wire and, FIGS. 3–6 are partially cross-sectioned views of the central cylindrical pasteboard core showing the lower end thereof with various arrangements for securing the loop element onto the bottom end of the core.

Referring now to the drawings, wherein the showings are for the purpose of illustrating the preferred embodiment of the invention and not for the purpose of limiting same, FIGS. 1 and 2 illustrate a wire transport drum constructed in accordance with the present invention and including a drum assembly A for receiving a loosely wound mass of welding wire W from a wire manufacturing facility. The wire is wound and deposited in drum assembly A for transportation to the automatic welding site where the drum is used as the supply of welding wire. Drum assembly A includes a pasteboard drum 10 which could be constructed of various appropriate material, which material is preferably electrically non-conductive. Drum 10 has an outer body 12 with an upper end 14, lower end 16 and inner cylindrical surface 18. A cylindrical bottom wall 20 is joined onto lower end 16 of drum body 12 at an intersection 22, which intersection often includes some type of seam not a part of the present invention and not illustrated in FIG. 1. To define the structure around which wire W is wound, assembly A includes a cylindrical pasteboard core 30 having a cylindrical inner surface 32, a cylindrical outer surface 34, an upper end 36 and a lower end 38. The upper end 36, when assembled in drum body 12, is below the top of the drum body so an appropriate closure can be provided. Annular wire receiving space 40 is defined by the outer surface 34 of cylindrical core 30 and the inner surface 18 of drum body 12. Into this annular space, wire W is loosely wound directly from the manufacturing equipment. During transportation, there is a tendency for the loosely wound wire to settle; therefore, to stabilize the wire mass during transportation, there is provided a biasing mechanism 50. This mechanism includes an upper disk or pressure ring 52 having an inner diameter 54 and an outer diameter 56, which diameters are greater than the diameter of outer surface 34 and less than the diameter of inner surface 18, respectively. Thus, pressure ring or disk 52 can be deposited on the top of the bulk of wire in space 40. In transportation, it is desirable to apply a downward force on pressure ring 52 to allow the ring to move downwardly as the volume of wire in space 40 is reduced by the transportation vibrations and other environmental conditions. To apply a downward force on ring 52 biasing mechanism 50 includes diametrically opposed, vertically extending slots 60, 62 for receiving a diametrically extending rod 70. Of course, slots 60, 62 could extend completely upward to the end of core 30; however, this would somewhat reduce the stability of the upper end of the core. An elastic band 72 is an elongated element having an upper loop 74 into which rod 70 is inserted as it extends through slots 60, 62. A lower hook 76 is tied onto band 72 for the purpose of engaging a lower loop element at the lower end of core 30 for pulling rod 70 downward against pressure ring 52. In accordance with the present invention, the loop element is a ribbon 80 that is generally flexible, but not stretchable to any substantial degree. In other words, it is not elastic, although it could be elastic, if desired. Ribbon 80 includes ends 82, 84 and a center bight portion 86. Securing means such as staples, rivets, glue or, as shown in another embodiment, knots, are used to secure ends 82, 84 adjacent the lower end of core 30. Ribbon 80 is attached to the cylindrical bottom wall 20, except as will be caused by the subsequent gluing operation. Thus, the present invention involves an arrangement where the loop element for the biasing mechanism is attached to the end of the core so it can be assembled onto the core before the core is assembled into drum 10. The securing arrangement in the preferred embodiment of the present invention, as illustrated in FIGS. 1 and 2 is essentially the same for securing ends 82, 84; therefore, the securing arrangement for only one end will be described in detail. As shown in FIG. 2, a notch 90 dimensioned to receive the cross section of ribbon 80 is provided on both sides of core 30 in position substantially orthogonal to the location of slots 60, 62. The ribbon end is secured to core end 38 by using a hole 92 in the core and a hole 94 in ribbon 80. Ribbon 96 passes through these holes to join ribbon end 84 to the outside surface 34 of core 30. After both ribbon ends are secured, as generally represented in FIG. 2, bight portion 86 is forced upwardly so ribbon 80 extends through notches 90 as illustrated in FIG. 1. At this time, it is preferred to apply a mass of glue or other adhesives G4 inside core 30 to further secure ribbon 80 onto the bottom or lower end of core 30. This gluing operation is a separate assembly step so that the core 30 with the affixed ribbon 80 is a subassembly manufactured and used subsequently for assembly into drum 10.

To assemble core 30 in drum 10 in a manner to withstand at least about 15 pounds of force on pressure ring 52, there is provided a pasteboard reenforcing plate 100 having a height 102 that is generally higher than the location of rivets 96. Plate 100 has an outer cylindrical periphery 104 that is closely spaced from inner surface 18 of drum 10 and an inner cylindrical periphery 106 closely adjacent outer surface 34 of core 30. Appropriate notches 108 provide clearance for ends 82, 84 and rivets 96. When core 30 is to be assembled onto the bottom wall 20, plate 100 is provided with glue G2 on its bottom surface and glue G1 on its outer periphery. Glue G3 may also be deposited on the inner periphery. Plate 100 is positioned in drum 10 and the lower end of core 30 is pushed into the opening defined by inner periphery 106 of plate 100. The dimensions of the plate peripheries center core 30 in drum 10. Additional glue G3 is then applied to fill notches 108, thus, capturing ends 82, 84 of ribbon 80. As glue deposits G1, G2 and G3 harden, core 30 is centrally located within drum 10 and is fixedly secured on bottom 20. The core and ribbon 80 have been previously joined. After the glue has set, drum 30 can withstand over 50 pounds of upward force. In practice, upward force created by element 72 is generally less than about 20 pounds.

After the wire has been deposited into space 40, pressure ring 52 is positioned onto the top of the mass formed by wire W. Thereafter, rod 70 is inserted through loop 74 and extends through slots 60, 62. Band or element 72 is manually stretched until hook 76 catches bight portion 86 of ribbon 80. Thereafter the band is released causing a downward force by rod 70 against ring 52. During transportation rod 70 maintains ring 52 against the upper end of the wire mass in space 40. Since the ring is near the top and element 72 extends the depth of drum 10, a relatively constant force is maintained on the wire which usually settles only 6–10 inches. As the wire becomes more compact, elastic element 72 maintains generally constant pressure through the action of rod 70 moving in slots 60, 62.

Figure 3:
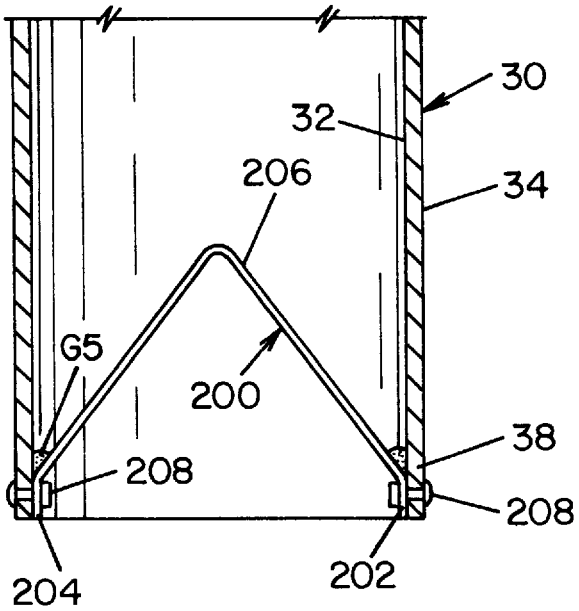

In accordance with the present invention, the loop element is formed at the lower end 38 of drum 30. Thus, element 72 has a relatively long length. This geometry is preferred, but may be varied. Several modifications of the present invention are illustrated in FIGS. 3, 4, 5 and 6. In FIG. 3, the loop element is a flexible band 200 having ends 202, 204 and a bight portion 206. Rivets 208 secure ends 202, 204 onto inner surface 32 of core 30, instead of mounting on the outer surface of the core. In this manner, there is no need for notches 90 as used in the preferred embodiment of the invention. When band 200 is assembled onto the lower end 38 of core 30, glue G5 can be deposited between ends 202, 204 and inner surface 32 to further secure the loop element onto core 30.

Figure 4:
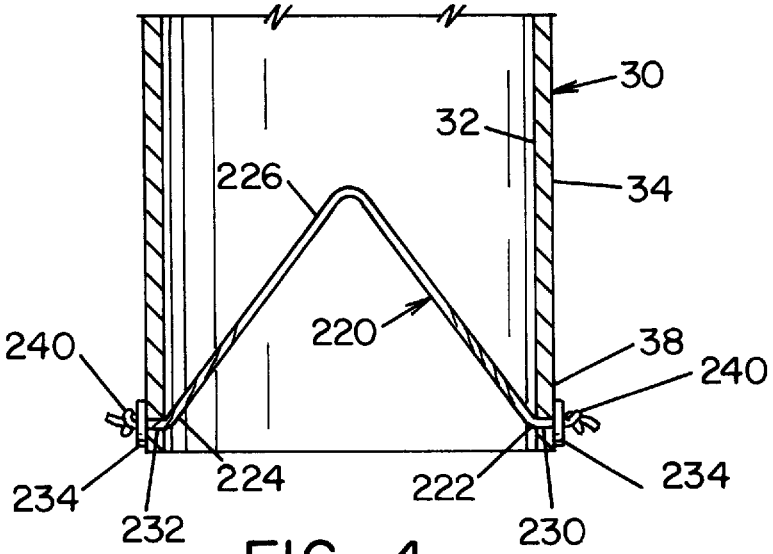
Figure 5:
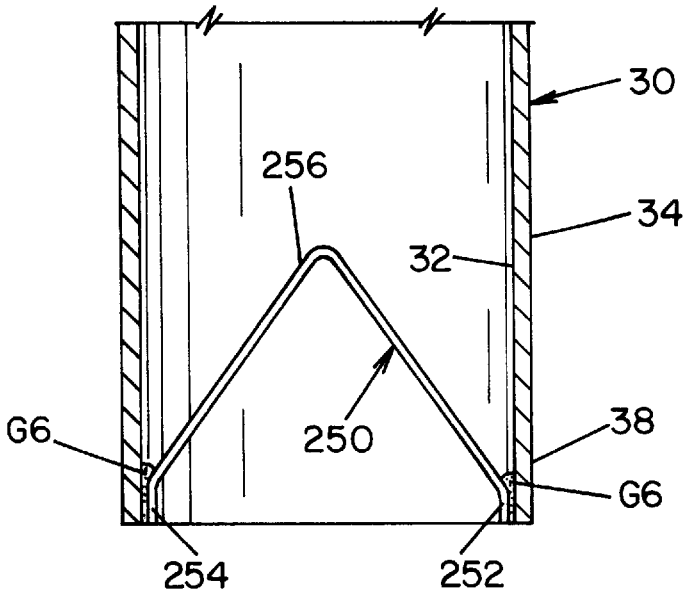
Figure 6:
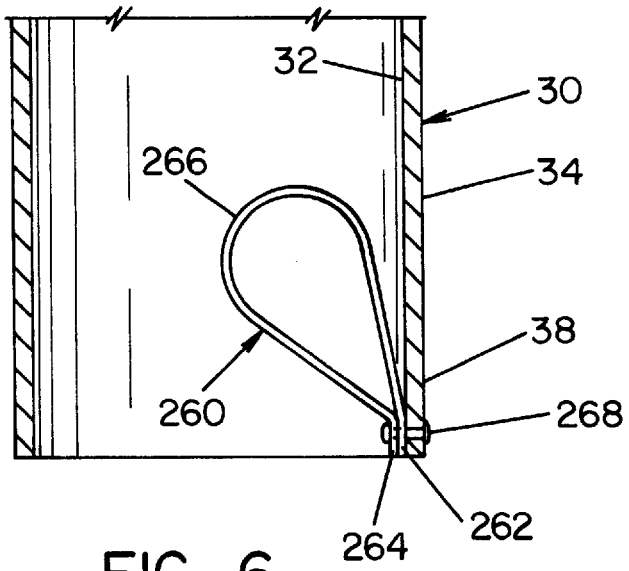

In FIG. 4, the loop element is a flexible cord 220 with ends 222, 224 and a bight portion 226. Holes 230, 232 receive the ends 222, 224, respectively. Two washers 234 on the outer surface of core 30 have holes to receive the ends of the cord. After the ends of cord 220 are passed through holes 230, 232 and through washers 234, knots 240 are tied to hold the cord in place. Cord 220 would not have the rigidity of ribbon 80; however, it could be captured by hook 76 manually in the same fashion as ribbon 80. Another alternative of the present invention is shown in FIG. 5 where the loop element is a flexible ribbon 250 having ends 252, 254 and a bight portion 256. The securing means in this particular embodiment of the invention is merely a mass of glue G6 securing ends 252, 254 onto the inner surface 32 of core 30. This modification is not preferred; however, it could be used in practicing the broad aspect of the present invention. Another alternative, which is also not an optimum arrangement, is illustrated in FIG. 6 wherein the loop element is again a flexible ribbon 260 having ends 262, 264 and a bight portion 266. In this embodiment, ends 262, 264 are joined together and secured to inner surface 32 by a single rivet 268. Bight portion 266 can be captured by hooks 76 with little difficulty. In this embodiment, it may be necessary to modify slots 60, 62 to be located on the opposite side of core 30 or even possibly slanting with respect to vertical.

In all embodiments of the present invention, the loop element is secured onto bottom end of core 30 so that the loop element and core can be assembled as a subassembly for subsequent gluing into drum 10. The securing means may take the form of the embodiments illustrated herein or equivalent structures using mechanical means, adhesives means or a combination mechanical and adhesive means. A wire spring member with outwardly extending barbs could be forced into the core and pushed to the bottom to form a mechanically captured loop element in core 30.

Having thus defined the invention, the following is claimed:

1. In a drum assembly for transporting a coil of loosely wound wire, said assembly comprising a drum with a cylindrical body having an upper end and a lower end and a circular bottom wall secured across said lower end; a cylindrical core having an inner cylindrical surface, an upper end and a lower end which is fixedly secured to said bottom wall to define an annular wire receiving space between said core and said body of said drum; and, a wire biasing mechanism for applying a downward force against wire in said wire receiving space, said biasing mechanism including a generally flat ring resting on said wire with an internal periphery larger than said core and an outer periphery smaller than said body and means for biasing said ring downwardly against said wire in said space wherein said biasing means includes vertically extending slots in the upper end of said core, a rod-like member extending through said slots and above said ring and an elongated, elastic element connected to said rod-like member and releasably attached to a loop element at the lower end of said core for pulling said rod-like member and said ring downwardly, the improvement comprising: said loop element being a flexible ribbon having first and second ends and a bight portion and means for fixedly attaching said ends of said ribbon to the core adjacent said lower end.

2. The improvement as defined in claim 1 wherein said attaching means is means for securing said ends of said ribbon to the inner cylindrical surface of said core.

3. The improvement as defined in claim 2 wherein said ends of said ribbon are secured together on said inner cylindrical surface.

4. The improvement as defined in claim 2 wherein said attaching means includes mechanical fasteners.

5. The improvement as defined in claim 4 wherein said attaching means includes glue for adhering said ends of said strap to said core.

6. The improvement as defined in claim 2 wherein said attaching means includes glue for adhering said ends of said ribbon to said core.

7. The improvement as defined in claim 1 wherein said attaching means includes glue for adhering said ends of said ribbon to said core.

8. The improvement as defined in claim 7 including a reinforcing plate glued to said bottom wall and with a center opening surrounding said lower end of said core and glue in said center opening for locking said plate to lower end of said core.

9. The improvement as defined in claim 2 including a reinforcing plate glued to said bottom wall and with a center opening surrounding said lower end of said core and glue in said center opening for locking said plate to lower end of said core.

10. The improvement as defined in claim 1 including a reinforcing plate glued to said bottom wall and with a center opening surrounding said lower end of said core and glue in said center opening for locking said plate to lower end of said core.

11. The improvement as defined in claim 1 wherein said attaching means is means for securing said ends of said ribbon to the outside surface of said core.

12. The improvement as defined in claim 11 wherein said attaching means includes mechanical fasteners.

13. The improvement as defined in claim 12 wherein said attaching means includes glue for adhering said ends of said ribbon to said core.

14. The improvement as defined in claim 11 wherein said attaching means includes glue for adhering said ends of said ribbon to said core.

15. The improvement as defined in claim 14 including a reinforcing plate glued to said bottom wall and with a center opening surrounding said lower end of said core and glue in said center opening for locking said plate to lower end of said core.

16. The improvement as defined in claim 12 including a reinforcing plate glued to said bottom wall and with a center opening surrounding said lower end of said core and glue in said center opening for locking said plate to lower end of said core.

17. The improvement as defined in claim 11 including a reinforcing plate glued to said bottom wall and with a center opening surrounding said lower end of said core and glue in said center opening for locking said plate to lower end of said core.

18. In a drum assembly for transporting a coil of loosely wound wire, said assembly comprising a drum with a cylindrical body having an upper end and a lower end and a circular bottom wall secured across said loser end; a cylindrical core having an inner cylindrical surface, an upper end and a lower end which is fixedly secured to said bottom wall to define an annular wire receiving space between said core and said body of said drum; and, a wire biasing mechanism for applying a downward force against wire in said wire receiving space, said biasing mechanism including a generally flat ring resting on said wire with an internal periphery larger than said core and an outer periphery smaller than said body and means for biasing said ring downwardly against said wire in said space wherein said biasing means includes vertically extending slots in the upper end of said core, a rod-like member extending through said slots and above said ring and an elongated, elastic element connected to said rod-like member and releasably attached to a loop element at the lower end of said core for pulling said rod-like member and said ring downwardly, the improvement comprising: said loop element being a flexible cord having first and second ends and a bight portion, two holes in said core adjacent said lower end and each said ends of said cord being extended through one of said holes and tied with a knot to prevent said ends from pulling into said cord.

19. The improvement as defined in claim 18 including a reinforcing plate glued to said bottom wall and with a center opening surrounding said lower end of said core and glue in said center opening for locking said plate to lower end of said core.

* * * * *